United States Patent [19]

Ciesemier et al.

[11] 4,344,060

[45] Aug. 10, 1982

[54] ENCLOSED PLUG-IN FUSE ASSEMBLY

[75] Inventors: Allen L. Ciesemier, Palatine; Robert J. Tait, Arlington Heights; Leonard A. Smith, Streamwood, all of Ill.

[73] Assignee: Littelfuse, Inc., Des Plaines, Ill.

[21] Appl. No.: 188,870

[22] Filed: Sep. 19, 1980

[51] Int. Cl.[3] ..... H01H 85/16

[52] U.S. Cl. ..... 337/260; 337/196; 337/212; 337/255; 29/623

[58] Field of Search ..... 337/260, 196, 212, 255; 29/623

[56] References Cited

U.S. PATENT DOCUMENTS 3,909,767 9/1975 Williamson et al. ..... 337/260

*Primary Examiner*—Harold Broome

*Attorney, Agent, or Firm*—Wallenstein, Wagner, Hattis, Strampel & Aubel

[57] ABSTRACT

A fuse assembly comprises a fuse unit and housing therefor made of insulating material and having an initially fully opened side through which said plug-in fuse unit was inserted into said housing. The fuse unit has a pair of spaced, parallel, confronting terminals with portions exposed to the exterior of said housing through spaced openings in the initially fully open side of the housing. A fuse link interconnects other portions of said terminals, the fuse link being positioned to pass by an initially uncovered portion of the initially fully open side of the housing as the fuse unit is inserted into the same. The housing has a closure flap which initially has a position exposing said portion of the initially fully open side of the housing so that the fuse link can pass into the housing therethrough. The flap is folded to cover this open housing portion when the fuse link passes into the housing. A shoulder on at least one of the spaced terminals abuts the folded closure flap when the fuse unit is fully inserted into the housing, which is then anchored to the terminals of the fuse unit.

5 Claims, 14 Drawing Figures

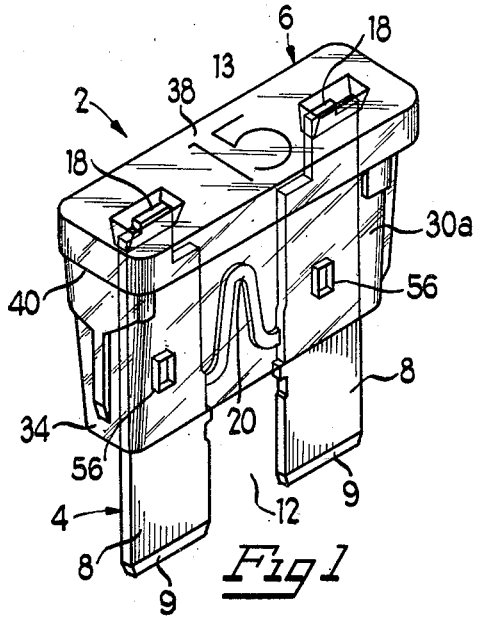
Fig 1
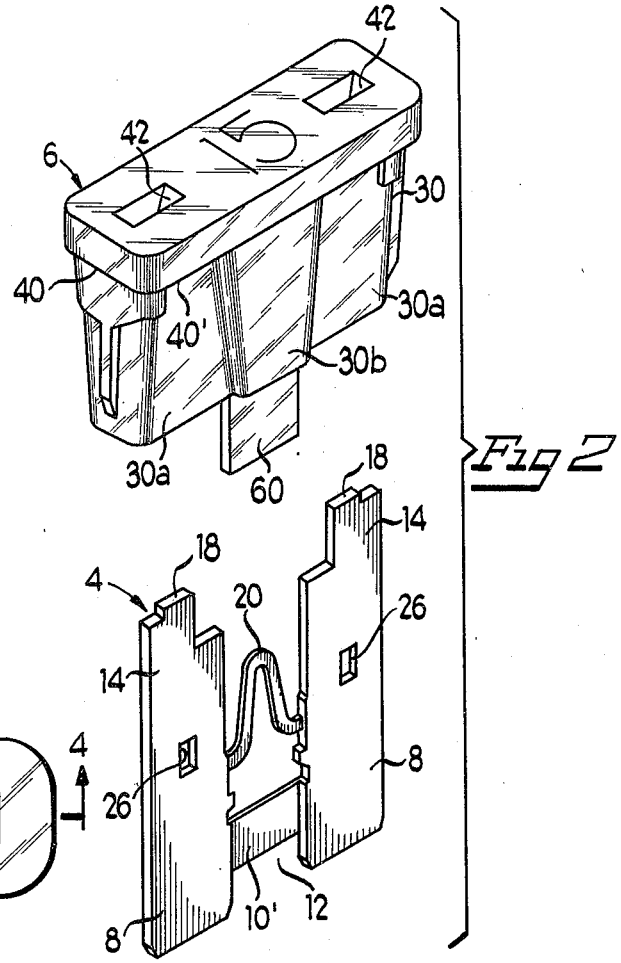
Fig 2
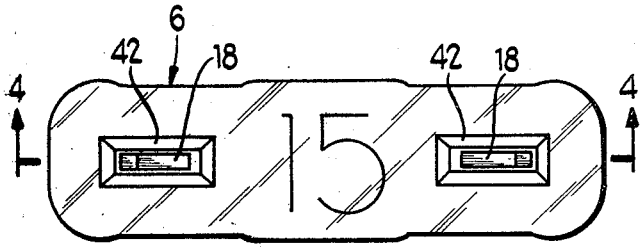
Fig 3
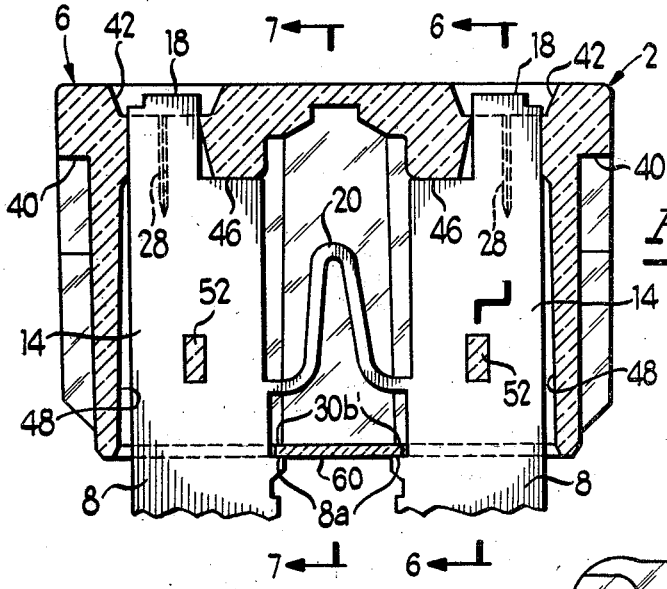
Fig 4
Fig 5
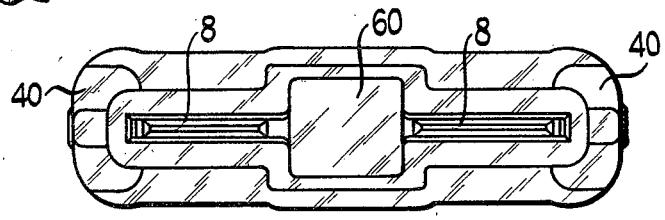

Fig 7
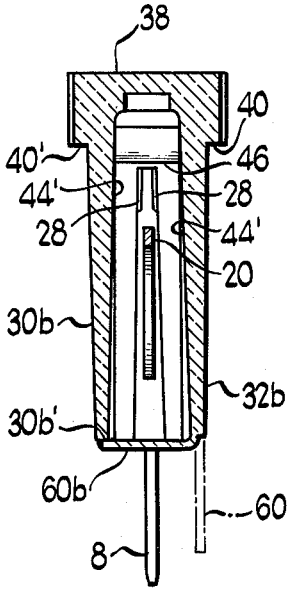
Fig 6
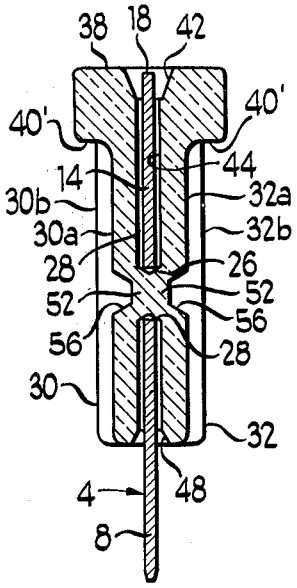
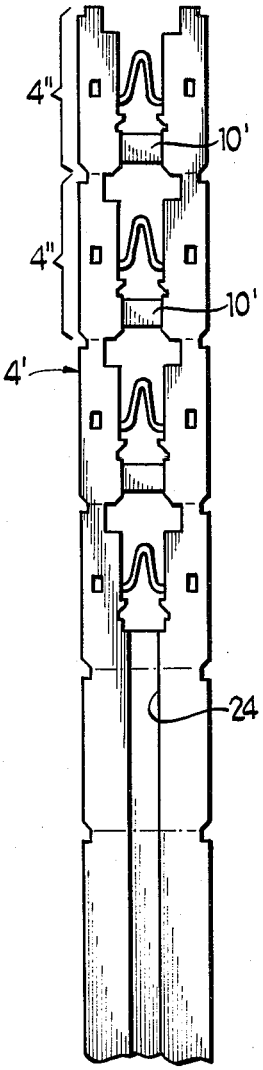
Fig 9
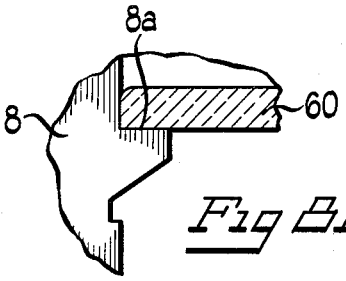
Fig 8A
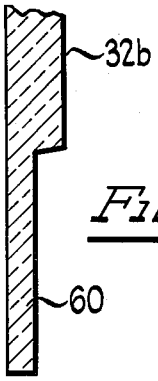
Fig 8B

ENCLOSED PLUG-IN FUSE ASSEMBLY

BACKGROUND OF THE INVENTION

The present invention relates to miniature current overload fuses which, whether they are rated to carry only a few amperes or as much as 30 amperes, occupy a space which is only a fraction of the space occupied by the conventional glass envelope cylindrical fuses.

An overload fuse capable of carrying currents of the above range of magnitudes commonly comprise a sealed cylindrical glass envelope with cylindrical terminals projecting from the ends thereof and a fuse link extending between the fuse terminals within the sealed cylindrical envelope. Fuses of this type having current ratings of 10—30 amperes commonly have lengths of the order of magnitude of over one inch and, together with the mounting terminals with which they are associated, an overall width of approximately one quarter inch and higher. Some of the disadvantages of this type of fuse are the large space requirements for mounting the same and difficulty in removing them from mounting clips.

A marked improvement in overload current fuses of the ratings referred to were made in the fuse designs disclosed in U.S. Pat. No. 3,909,767. In the fuses disclosed in this and other related patents, the terminals of the fuse project in spaced confronting relation from a narrow housing acting as a convenient insulated gripping means. The terminals plug into less expensive and less bulky socket clips than the connectors needed for conventional cylindrical type fuses.

This unique fuse is preferably a two-piece assembly comprising the housing and plug-in fuse metal element including a plate-like body of fuse metal having a pair of spaced confronting terminal blade portions, current carrying extensions at the inner end portions of the pair of terminal blade portions and a fuse link portion of reduced thickness interconnecting the current-carrying extensions. The housing has confronting closely spaced main side walls interconnected on three sides by narrow walls, the fourth side having a narrow opening preferably extending for substantially the full length thereof for insertion of the plug-in fuse element. The main walls of the housing are preferably staked into apertures formed in the plug-in fuse element. The terminal blade portions of the plug-in fuse element project from the open side of the housing and plug into socket clips in the mounting panel. When the fuse assembly is plugged into the mounting panel clips, the mounting panel forms a barrier, preventing blown fuse metal from spewing outside of the housing through the open side of this housing covered by the mounting panel. However, some users prefer that the housing completely enclose the plug-in fuse element so that the housing rather than the mounting panel prevents passage of blown fuse metal to the outside of the housing.

As disclosed in U.S. Pat. No. 3,909,767, the plug-in fuse element is formed from a fuse metal strip in which successive longitudinal portions of the strip are progressively die stamped to form initially interconnected plug-in fuse element blanks. The housing for the endmost blank is applied thereover before the blank is severed from the strip. The housing is staked or otherwise anchored to the blank, following which an almost completed fuse assembly is separated from the strip, to expose the next blank of the strip for insertion of a similar housing.

Various approaches have been suggested for completely enclosing the fuse link portion of a plug-in fuse element. For example, a housing could be a molded body of synthetic plastic material intimately surrounding the fuse link. However, this complicates the fabrication process and the intimate surrounding of the fuse link with synthetic plastic material could adversely affect the blowing characteristic thereof. Another approach is to form the housing in two parts, the main part having an open top and a pair of openings in the bottom thereof for receiving insertion of the terminals of the plug-in fuse element to be supported in the housing. A cover is then inserted over and ultrasonically welded to the top of the housing. This construction was found unsatisfactory for a number of reasons including the fact that sometimes the housing cover would come loose from the main housing part. Also, the assembly required for this construction is more complicated and expensive than desired. It is, accordingly, an object of the invention to provide a fuse assembly preferably of the type just described and disclosed in U.S. Pat. No. 3,909,767, and further wherein the housing forms a substantially complete enclosure for the fuse link portion of the plug-in fuse element so that blown fuse metal cannot gain access to the exterior of the fuse assembly housing. A related object of the invention is to provide a fuse assembly as just described that lends itself to the mass production thereof in a similar way to which the plug-in fuse assembly disclosed in U.S. Pat. No. 3,909,767 is fabricated.

SUMMARY OF THE INVENTION

In accordance with the most preferred form of the invention, a single piece initially fully opened housing like that previously described is utilized, but modified by adding thereto a closure flap which initially forms the extension of one of the main side walls of the housing adjacent to the portion of the initially open side thereof where the fuse link portion of the plug-in element passes into the housing. After the fuse link portion of the plug-in fuse element passes inside of the housing, this flap is folded to cover the portion of the initially fully open end of the housing between the open portions thereof from which the terminal blade portions of the plug-in fuse element project from the housing with no clearances for passage of blown fuse metal to the exterior of the housing when the fuse blows.

This closure flap can be held in its folded position by adhesives or ultrasonic welds. However, these flap retaining procedures were found unsatisfactory. Adhesives sometimes lose their bonding strength and they undesirably discolor the preferably transparent housings. The use of ultrasonic welds was found unsatisfactory because the vibration required in the welding process sometimes causes or widens existing cracks in the flap formed in the process of folding the same, and ultimately cause the flap to break away from the housing. Staking the flap in its folded position also was found to be unsatisfactory.

In accordance with a specific and preferred aspect of the invention, the folded flap is held in its folded position by shoulders formed on the confronting terminal blade portions of the plug-in fuse element. Thus, in the process of applying a housing over the endmost blank in the die-stamped fuse metal strip previously described, before the housing is fully inserted over the endmost blank of the fuse metal strip, the flap is folded, and as the housing is fully pushed into position over the blank, the shoulders stamped into the terminal blade portions of the blank engage the folded flap to retain it in the folded position. The housing is then anchored to the plug-in fuse element.

Other object, advantages and features of the invention will become apparent upon making reference to the specification and claims to follow and the drawings.

DESCRIPTION OF DRAWINGS

FIG. 1 is a perspective view of a preferred form of the plug-in fuse assembly of the invention;

FIG. 2 is an exploded view of the housing and plug-in fuse element for making up the plug-in fuse assembly of FIG. 1;

FIG. 3 is a top plan view of the plug-in fuse assembly of FIG. 1;

FIG. 4 is a vertical longitudinal sectional view through the plug-in fuse assembly shown in FIG. 3, taken along section line 4—4 therein;

FIG. 5 is an enlarged bottom view of the plug-in fuse assembly of FIG. 1;

FIG. 6 is an enlarged transverse vertical sectional view through the plug-in fuse assembly shown in FIG. 4, taken along section line 6—6 thereof;

FIG. 7 is an enlarged vertical transverse sectional view through the center portion of the plug-in fuse assembly shown in FIG. 4, taken along section line 7—7 thereof;

FIG. 8A is a greatly enlarged fragmentary sectional view through the closure flap portion of the assembly housing and shows a flap retainer shoulder on a fuse element terminal which holds the flap closed;

FIG. 8B is a greatly enlarged fragmentary view of the bottom of a side wall of the fuse assembly housing, showing the closure flap extending therefrom before it is folded into a housing-closing position;

FIG. 9 is a top view of a strip fuse metal from which plug in fuse elements like that shown in FIGS. 2 and 3 are made in a mass production operation, the strip shown being progressively die-stamped to form interconnected plug-in fuse element-forming blanks over the endmost of which an initially fully open housing is applied.

DESCRIPTION OF EXEMPLARY FORM OF THE INVENTION SHOWN IN THE DRAWINGS

Figure 10A:
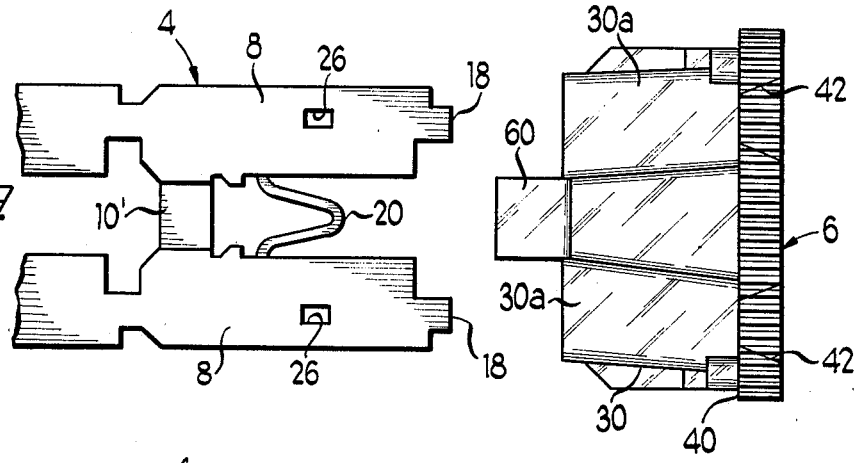
FIGS. 10A, 10B, 10C and 10D, show a progression of the positions of the housing and closure flap thereof as the housing is progressively applied over the endmost blank shown in FIG. 9.
Figure 10B:
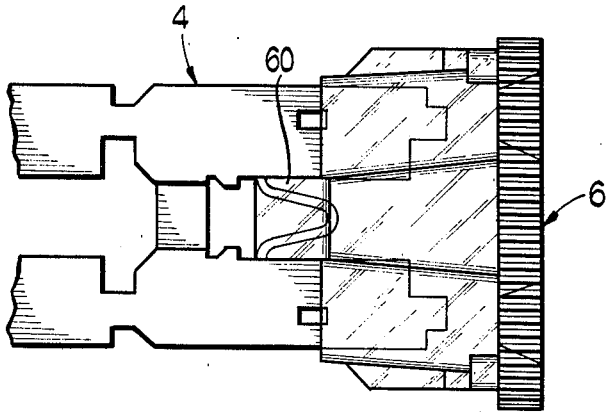

Referring now more particularly to FIGS. 1—4, there is shown a plug-in fuse assembly 2 made of only two component parts, namely a plug-in fuse element 4 which most advantageously is a single stamping from a strip of fuse metal, and a housing 6 which most advantageously is a single piece synthetic plastic material molded part defining a space therein in which portions of the plug-in fuse element 4 are located and secured in any suitable way, but most preferably by cold staking and ultrasonic welding operations.

The plug-in fuse element 4 has terminal blade portions 8—8 plated with a highly conductive metal like tin, and extending in spaced confronting parallel relationship from the inner or bottom margin of the housing 6 in what will be referred to as downwardly or inwardly extending direction. The ends of the terminal blade portions 8—8 of the plug-in fuse element, which are spaced apart as indicated at 12, are most advantageously tapered at 9—9 to form pointed end portions which readily slip into place between the confronting walls of conventional spring clip terminals (not shown) supported in mounting panel sockets. The current rating of the plug-in fuse assembly is indicated by indicia 13 on the outer wall of the housing as shown in FIGS. 1—2 and/or by a distinctive housing color.

The plug-in fuse element 4 may be formed from a partially tin plated strip 4' of fuse metal (FIG. 9). Prior to the plug-in fuse element being severed from the strip 4', the terminal blade portion 8—8 may be interconnected by a transverse rigidifying web 10' stamped from a reduced portion of the strip. The stamping operation also forms the terminal blade portions 8—8 defined by a gap 12 between the same. The tapered portions 9—9 of the terminal blade portions 8—8 may be formed by coining dies (not shown) preferably after the operation which severs the plug-in fuse element from the strip.

The terminal blade portions 8—8 have current-carrying extensions 14—14 which are preferably tin plated at least at the outer end portions thereof where continuity checking probe-receiving tabs 18—18 are formed. The current-carrying extensions are located in various spaces formed by the housing 6 where they are contiguous to the main side walls of the housing to be described. The current-carrying extensions 14—14 are interconnected by an unplated fuse link portion 20 which is preferably both narrower in width and much smaller in thickness than the other current-carrying portions of the plug-in fuse element 4. (However, especially large current rated fuses could have the same thickness as the other portion of the plug-in fuse element.) The current carrying capacity of the fuse link portion 20 is varied by varying its location and/or its configuration including its width and length dimensions.

The outer end portions of the terminal extensions 14—14 of the plug-in fuse element 4 are provided with outwardly or upwardly projecting tabs 18—18 adapted to make contact with test probes to test for the continuity of the fuse link portion 20 of the plug-in fuse element 4. Also, to anchor the plug-in fuse element 4 within the housing 6, anchoring openings 26—26 are formed in the terminal extensions 14—14 to receive anchoring projections to be described formed in the housing walls.

The housing 6 is most advantageously a single piece molded part as previously indicated. Also, it preferably has a narrow elongated configuration formed by relatively closely spaced main or side walls generally indicated by reference numeral 30—32, the side walls having end portions **30*a*—32*a* and 30*a*—32*a* which are spaced together much more closely than the central or intermediate portions 30*b*—32*b* thereof. The side walls 30—32 are interconnected at their end margins by narrow end walls 34—34, and at their outer or top margins by an outer narrow wall 38 which overhangs the rest of the housing to form downwardly facing shoulders 40—40 at the longitudinal ends of the outer wall 38 and downwardly facing shoulders 40'—40' along the longitudinal side margins of the housing 6. The shoulders 40'—40' are coplanar continuations of the shoulders 40—40 at the ends of the housing 6**.

Terminal access openings 42—42 are provided in the outer wall 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test probes can be guided snugly into contact with the tabs 18—18. The terminal access openings 42—42 communicate with the aforementioned plug-in fuse element receiving space in housing 4. The portions 44—44 of this space immediately beneath the access openings 42—42 are relatively small because of the close spacing of the side wall portions 30*a*—32*a* of the housing at these points, the width of the space portions 44—44 as viewed in FIG. 6 tapering from the bottom open end of the housing upwardly toward the terminal access openings 42—42, reaching a narrow dimension about equal to the thickness of the plug-in fuse element 4. The space portions 44—44 are provided on opposite sides thereof with small inwardly directed ribs 28 for engaging and centering the upper portions of the plug-in fuse element 4 in the housing 6. At the inner margins of the terminal access openings 42—42 the upper wall 38 is provided with downwardly extending skirts 46—46 which act as shield walls preventing spewing fuse metal from gaining entrance to the terminal access openings 42—42. These shield forming skirts 46—46 also act as stop or abutment shoulders for the current-carrying extensions 14—14 of the terminal blade portions 8—8 of the plug-in fuse element.

The fuse link portion 20 of the fuse element 4 is positioned in a relatively wide portion 44' (FIG. 7) of the housing interior.

The narrow and wide portions 44—44 and 44' of the space within the housing 6 before the housing receives the plug-in fuse element 4 open onto the bottom of the housing for the full extent thereof through an entry opening which permits the housing to be pushed over the endmost blank of the pre-stamped and milled strip 4'.

The housing 6 is preferably a molded part made of a transparent synthetic plastic material so that the fuse-forming filament portion 20 of the plug-in fuse element 4 is readily visible through the intermediate portion of the outer wall 38, with which the fuse link portion 20 is in spaced relation. The housing is preferably molded of a high temperature transparent mylar nylon made by Union Carbide under the trademark "POLYSULFONE" and order No. P1700, Natural 11.

While the housing interior 6 could be made with resilient projections which snap into the anchoring apertures or openings 26—26 in the plug-in fuse element 4, it is preferred to secure the housing in place by forming projections 52 from both sides of the housing 6 by a cold staking operation, which projections enter the anchoring apertures 26—26 of the plug-in fuse element 4. The inwardly extending projections 52 formed by the cold staking operation, where they engage each other in the anchoring apertures or openings 26, are preferably welded together by an ultrasonic welding operation to provide a rigid anchoring structure. The depressions 56 left by the staking operation are shown in the side wall 30 in FIGS. 1 and 6.

As previously indicated, what appears in FIG. 2 to be the bottom of housing 6 is initially fully open so that this side thereof can be inserted over the endmost blank of the fuse metal strip 4', as shown in FIGS. 10A, 10B, 10C and 10D. The fuse-forming link portion 20 of the plug-infused filament 4 passes through the intermediate portion of the fully open side of the housing. As this fuse link portion 20 passes into the housing 6 (FIGS. 10B and 10C), a closure flap 60 provided on the housing is folded, closing off this intermediate portion of the open side of the housing. The closure flap 60, best shown in FIGS. 2 and 8B, is shown prior to assembly of the housing over the endmost blank of the fuse metal strip 4', where it extends in-line from the bottom end of the intermediate portion 32*b* of the main side wall 32 of the housing 6. The closure flap 60 preferably has a thickness much less than the thickness of intermediate portion 32*b* of the main side wall 32, so that it can be more readily folded against a shoulder 30*b'* in the bottom of the main side wall 32 of the housing. The closure flap is held against the shoulder 30*b'* by shoulders 8*a*—8*a* formed on the terminal blade portions 8—8 of the plug-in fuse element 4.

Figure 10C:
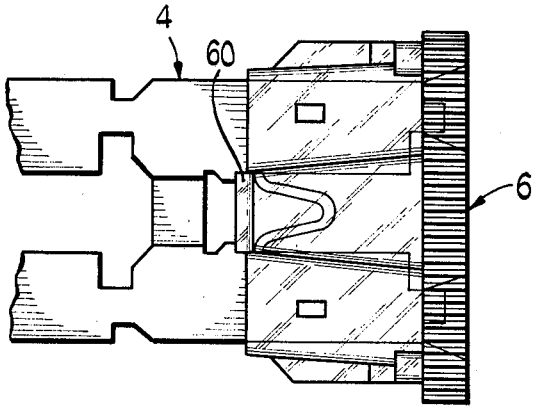
Figure 10D:
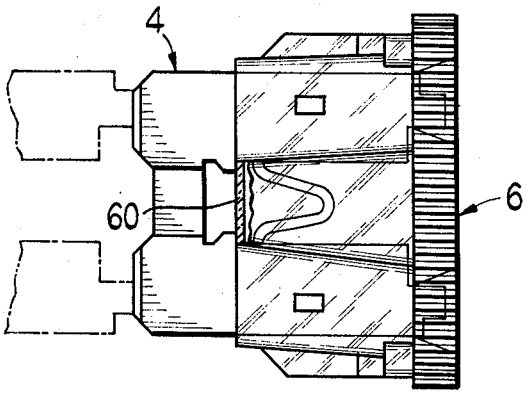

Reference should again be made to FIGS. 10A, 10B, 10C and 10D which show the manner in which the housing 6 is assembled over the endmost blank of the fuse metal strip 4'. The open side of housing 6 is pushed over the endmost blank, and, as the fuse link portion 20 of the plug-in fuse element 4 passes into the housing through the intermediate portion of the initially fully opened side of the housing, flap 60 is folded (FIGS. 10C and 10D) against shoulder 30*b* of side wall 30. When the housing is fully inserted over the endmost blank, the terminal blade shoulders 8*a*—8*a* bear against fully folded flap 60. The housing 6 is then cold-staked into the terminal blade extension apertures 26—26, as shown in FIG. 10C. Finally, the end blank with attached housing, is severed from the strip 4' with the connecting link 10' preferably still in place. The fuse assemblies so formed from the strip 4' are subsequently subjected to ultrasonic welding operations which complete the securement of the housing on the plugged-fused element 4. Then, the link 10 can be severed from the assembly.

It is thus apparent that the preferred form of closure means of the present invention is designed to be readily utilized in a mass production assembly operation like that described. Obviously, the fuse metal strip 4' and the housing 6 are held and manipulated by automatic machinery not disclosed herein.

It should be understood that numerous modifications can be made of the most preferred form of the invention described without deviating from the broader aspects thereof.

The exemplary embodiment of the invention just described has thus provided an exceedingly reliable, enclosed, compact and inexpensive to manufacture plug-in fuse assembly which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse link portion of plug-in fuse element can be viewed when the plug-in fuse assembly is mounted on the mounting panel. The terminal access openings enable test equipment to test the continuity of the fuse if the user does not desire to rely solely on a visual observation of the fuse link portion of the fuse.

It should be understood that numerous modifications may be made in the most preferred form of the invention described without deviating from the broader aspects thereof.

We claim:

1. In a fuse assembly comprising a fuse unit and a housing for said fuse unit made of insulating material and having an initially fully open side through which said plug-in fuse unit was inserted into said housing, said fuse unit having a pair of confronting spaced terminals projecting to the exterior of said housing through spaced openings in said initially fully open side of said housing, and a fuse link interconnecting extensions of said pair of terminals, said fuse link being positioned to pass through the entry portion of said initially fully open side of said housing as the fuse link entered said housing, the improvement wherein said fuse link entry portion of said initially fully open side of said housing is closed between said spaced openings by a closure flap extending from said housing and folded, after at least partial insertion of said fuse unit into said housing, into a position closing said portion of said initially fully open side of said housing, said folded closure flap and the relationship between said terminals of the fuse unit and the housing openings preventing the passage of pieces of blown fuse link to the exterior of the housing, and means for holding said closure flap in the folded condition comprising a shoulder on at least one of the said plug-in fuse unit terminals.

2. The fuse assembly of claim 1 wherein said housing has closely spaced, relatively wide main side walls, the margin of which are interconnected by narrow walls on the three sides thereof, said initially fully open side of the housing being defined between the remaining side of said side walls, said terminals of the fuse unit having substantially flat parallel, coplanar configurations.

3. The fuse assembly of claim 2 wherein said main side walls of said housing are staked to said terminal extensions.

4. The base assembly of claim 1 or 2 wherein said flap is held in its folded position by shoulders on both of said terminals.

5. A method of making a fuse assembly comprising a fuse unit and a housing therefor made of insulating material and having an initially fully opened side through which said fuse unit can be inserted into said housing, said fuse unit having a pair of spaced, parallel, confronting terminals having portions exposed to the exterior of said housing through said open side of said housing, and a fuse link interconnecting other portions of said terminals, said fuse link being positioned to pass by a portion of said initially fully open side of said housing as the fuse unit is inserted into said housing, said method comprising providing said housing with a closure flap which initially has a position exposing said portion of said initially fully open side of said housing so that said fuse link and the rest of the fuse unit to be enclosed thereby can pass into said housing, said flap being foldable to cover said portion after partial insertion of said fuse unit into the housing; providing a shoulder on at least one of said spaced terminals which shoulder has a position to abut said closure flap after the flap has been folded to cover said portion of the initially fully open side of said housing immediately after said fuse link passes by said portion thereof, so that said shoulder will hold said closure flap in said folded position when the fuse unit is fully inserted into said housing passing said fuse unit through said initially fully open side of said housing, and folding said flap to cover said housing portion, said shoulder abutting said folded flap to retain it in said folded condition when said fuse unit is fully inserted into said housing and then anchoring said housing to the terminal of said fuse unit.

* * * * *